US007491877B1

(12) United States Patent
Cherny

(10) Patent No.: US 7,491,877 B1
(45) Date of Patent: Feb. 17, 2009

(54) DRUM SHELL MOUNTING SYSTEM AND ASSOCIATED METHODS

(76) Inventor: Michale N. Cherny, 3944 SE. 17th La., Ocala, FL (US) 34471-5621

( * ) Notice: Subject to any disclaimer, the term of this patent is extended or adjusted under 35 U.S.C. 154(b) by 0 days.

(21) Appl. No.: 11/760,143

(22) Filed: Jun. 8, 2007

Related U.S. Application Data

(60) Provisional application No. 60/804,337, filed on Jun. 9, 2006.

(51) Int. Cl.
*G10D 13/02* (2006.01)

(52) U.S. Cl. ..... 84/421; 84/411 R

(58) Field of Classification Search ..... 84/421, 84/411 R

See application file for complete search history.

(56) References Cited

U.S. PATENT DOCUMENTS 3,136,201 A * 6/1964 Lang et al. ..... 84/411 R
3,541,913 A * 11/1970 Severino ..... 84/413
4,211,144 A * 7/1980 May ..... 84/411
4,334,458 A 6/1982 Grauso
4,448,105 A 5/1984 Cordes
4,714,002 A 12/1987 Cleland
4,869,146 A * 9/1989 Bonsor ..... 84/413
5,413,022 A * 5/1995 Sleishman ..... 84/413
5,447,087 A * 9/1995 Hawes et al. ..... 84/413
5,546,841 A 8/1996 Chen
5,606,142 A 2/1997 Volpp
5,841,049 A * 11/1998 Strawn ..... 84/411 R
5,977,463 A 11/1999 Bartlett
6,417,432 B1 7/2002 Downing
6,765,139 B2 7/2004 Belli
6,963,022 B2 * 11/2005 Okuno ..... 84/413

* cited by examiner

*Primary Examiner*—Walter Benson
*Assistant Examiner*—Jianchun Qin
(74) *Attorney, Agent, or Firm*—Allen Dyer Doppelt Milbrath & Gilchrist, P.A.

(57) ABSTRACT

A drum shell mounting system includes a cylindrical cage that has an outer diameter less than a drum head diameter and a plurality of windows. The cage's bore is larger than the drum shell's. A plurality of posts extend outwardly and have apertures for receiving fasteners. Removably affixable mounting clips extend into the cage's bore. In use, drum assembly proceeds by affixing the mounting clip to the cage and inserting the drum head into the cage's bore. A spacing between the cage's inner face and the drum head is maintained by the mounting clip, the drum head is placed atop the cage with a rim of the drum head positioned outside a top edge of the cage, a hoop is placed around the drum head, fasteners are inserted through hoop apertures and into the post apertures to secure the head, and the mounting clips are removed.

17 Claims, 5 Drawing Sheets

DRUM SHELL MOUNTING SYSTEM AND ASSOCIATED METHODS

CROSS-REFERENCE TO RELATED APPLICATION

This application claims priority to provisional application Ser. No. 60/804,337, filed Jun. 9, 2006.

BACKGROUND OF THE INVENTION

1. Field of the Invention

The present invention relates to systems and methods for percussion instruments, and, more particularly, to such systems and methods for mounting drum shells.

2. Description of Related Art

Conventional drums are known to comprise a generally cylindrical shell with a drum head affixed at least one end, for example, with the use of a rim. In such a system, the head thereby is in direct contact with the shell, and the shell is typically bored through to permit access by the attachment means. This is believed to be a less than desirable practice, since such direct contact dampens the shell's vibration and its resonance. Therefore, attempts have been made in the art to eliminate this direct attachment and drilling of holes in the shell by encasing free-floating drum shells in cage-like devices affixed between the top and bottom heads. Drum tuning mechanisms are also known in the art that similarly include a free-floating drum shell.

However, the prior art systems are difficult to align and tune. Therefore, it would be desirable to provide a drum shell mounting system wherein the drum shell is free-floating with respect to the heads, that is easier to align, and that is easily tunable.

SUMMARY OF THE INVENTION

The present invention is directed to a drum shell mounting system that comprises a generally cylindrical cage that has an outer diameter less than a diameter of a drum head. At least one, a preferably a plurality of, windows extend from an outer face through to an inner face thereof. The cage has a bore therethrough that is dimensioned to admit a drum shell. The bore has a diameter that is larger than a diameter of the drum shell to be placed therein.

A plurality of posts are affixed to and extend outwardly from the cage's outer face in circumferentially spaced relation therearound. The posts each have an aperture that extends from a top end thereof. The apertures are substantially parallel to a cylindrical axis of the cage and are adapted to receive fasteners thereinto for affixing a drum head thereto.

A mounting clip is removably affixable to the cage and has an inner portion that is extendable into the cage bore by a width approximately equal to a difference between the cage bore's diameter and a diameter of the drum head.

In use, drum assembly proceeds by affixing the mounting clip to the cage and inserting the drum head into the cage's bore. A spacing between the cage's inner face and the drum head is maintained by the mounting clip inner portion, the drum head is placed atop the cage with a rim of the drum head positioned outside a top edge of the cage, a hoop is placed in surrounding relation to the drum head, fasteners are inserted through hoop apertures and into the post apertures to secure the head, and the mounting clip is removed.

A second embodiment of the invention is directed to a drum shell mounting system. This embodiment of the system comprises a generally cylindrical cage that has a wall portion having an outer diameter less than a diameter of a drum head. A window extends from an outer face through to an inner face thereof. An axial bore through the cage is dimensioned to admit a drum shell and has a diameter larger than a diameter of the drum shell to be placed therein. A spacer hole through the wall portion extends from the outer face through to the inner face.

A plurality of posts are affixed to and extend outwardly from the cage outer face in circumferentially spaced relation therearound. The posts each have an aperture extending from a top end thereof, the apertures substantially parallel to a cylindrical axis of the cage. The apertures are for receiving fasteners thereinto for affixing a drum head thereto.

A spacer has an insertion portion that is dimensioned for insertion into a hole in the drum shell. The spacer has a head portion that is larger than the drum shell hole and has a portion having an axial bore therein extending from an outer face thereof.

A pin has an insertion portion that is dimensioned for insertion through the cage's spacer hole and into the spacer axial bore. The pin and the spacer thereby retain the drum shell in spaced relation from the cage by a space determined by an axial height of the spacer's head portion.

The features that characterize the invention, both as to organization and method of operation, together with further objects and advantages thereof, will be better understood from the following description used in conjunction with the accompanying drawing. It is to be expressly understood that the drawing is for the purpose of illustration and description and is not intended as a definition of the limits of the invention. These and other objects attained, and advantages offered, by the present invention will become more fully apparent as the description that now follows is read in conjunction with the accompanying drawing.

DETAILED DESCRIPTION OF THE PREFERRED EMBODIMENTS

Figure 1:
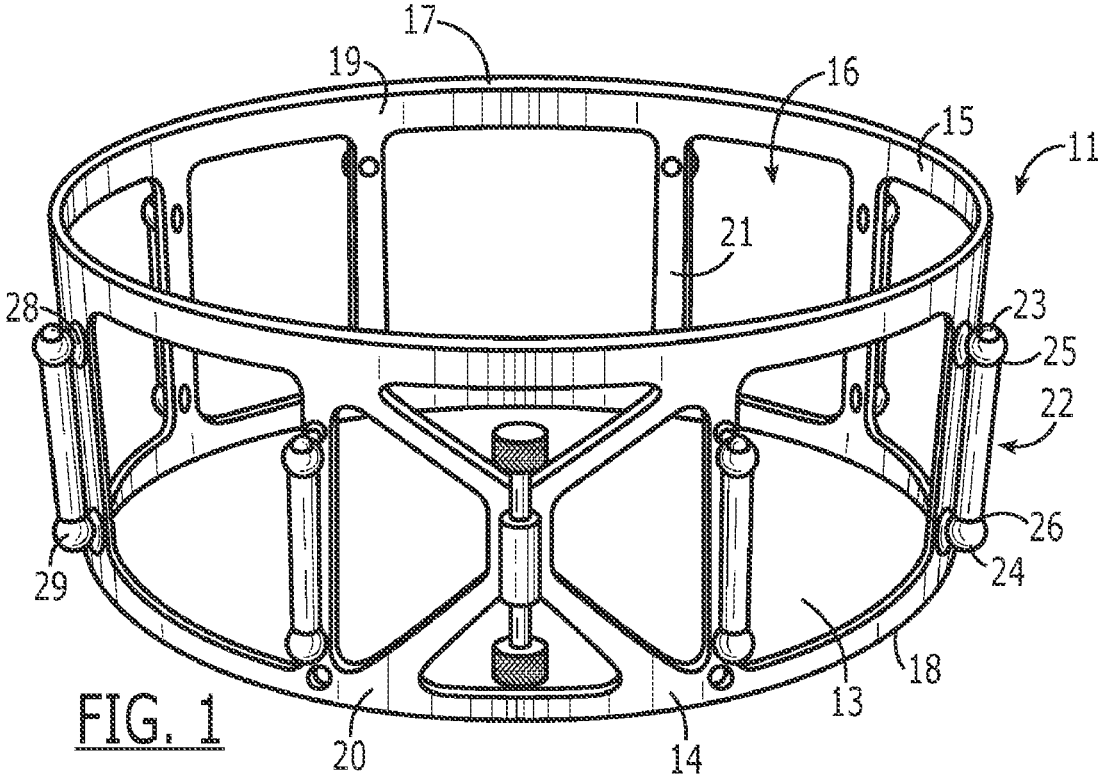
FIG. 1 is a top-side perspective view of the drum shell cage of the present invention.
Figure 2:
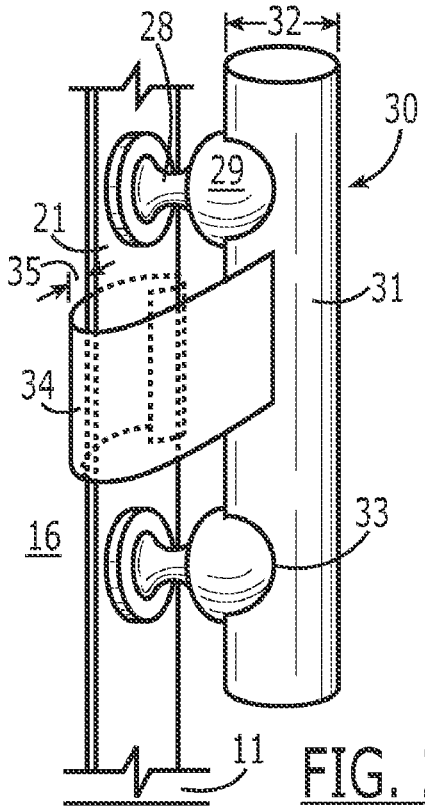
FIG. 2 is a side perspective view of a mounting clip positioned on a post.
Figure 3:
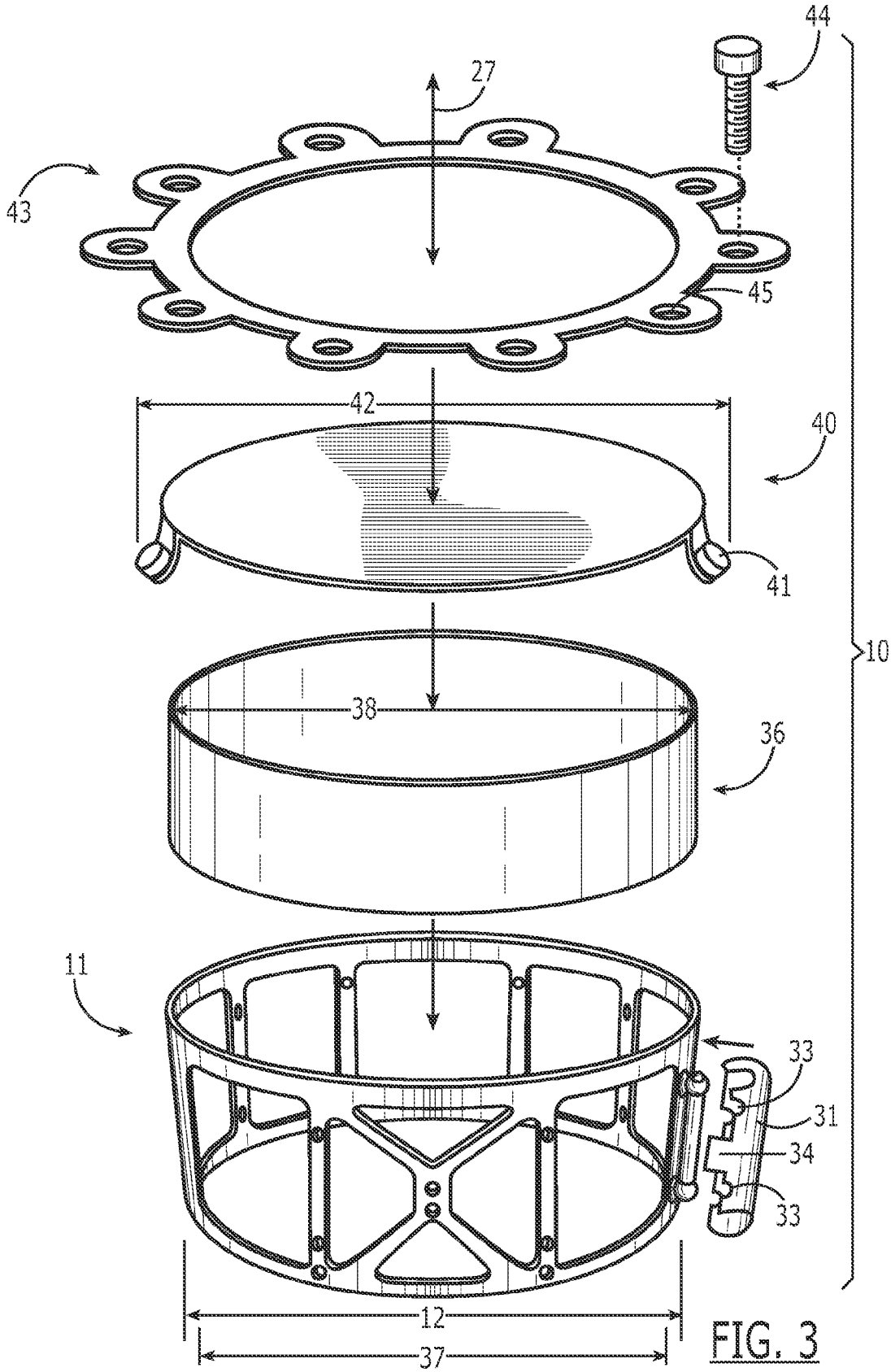
FIG. 3 is an exploded view of the drum elements.

A description of the preferred embodiments of the present invention will now be presented with reference to FIGS. 1-8.

The present invention is directed to a drum shell mounting system 10 (FIGS. 1-4) that comprises a generally cylindrical cage 11 (FIG. 1) that has an outer diameter 12. At least one, a preferably a plurality of, windows 13 extend from an outer face 14 through to an inner face 15 of the cage 11. The cage 11 has a bore 16 therethrough from a top edge 17 to a bottom edge 18. In a preferred embodiment, the windows 13 comprise a greater surface area than the solid material of the cage 11, leaving an upper rim portion 19 beneath the top edge 17 and a lower rim portion 20 above the bottom edge 18, with cross-pieces 21 extending therebetween to define the windows 13.

Extending outward from the cage's outer face 14 is a plurality of posts 22, here 10 posts, in circumferentially spaced relation therearound. The posts 22 in a preferred embodiment are equal in number to the cross-pieces 21, although this is not intended as a limitation. Each of the posts 22 has an upper 23 and a lower 24 threaded aperture that extend, respectively, from a top 25 and a bottom 26 end thereof. The apertures 23,24 are substantially parallel to a cylindrical axis 27 of the cage 11 and are adapted to receive fasteners thereinto for affixing a drum head thereto. Further, the posts 22 are affixed to the cage 11 in spaced relation therefrom using standoffs 28, and are shorter than the cage's height. The post standoffs 28 in a particular embodiment comprise knob-like elements 29 at their distal ends.

An important feature of the invention includes a mounting clip 30 (FIG. 2), which is removably affixable to the cage 11. In a preferred embodiment, the clip 30 is affixable to a post 22. This embodiment of the clip 30 comprises a generally semi-cylindrical affixing portion 31 that has a diameter 32 adapted to slip over a post 22, and four cutouts 33 positioned and dimensioned for partially surrounding the knobs 29. A curved and semi-cylindrical inner portion 34 extends proximally into the cage's bore 16 to retain a spacing 35 from the cage's inner face 15. The operation of the mounting clip 30 will be discussed in the following.

Drum assembly proceeds (FIG. 3) by affixing four mounting clips 30 to four equally spaced-apart posts 22. A drum shell 36 is then inserted into the cage's bore 16. The cage's inner diameter 37 is less than the diameter 38 of the drum shell 36. The mounting clips's inner portion 34 has a width that is approximately equal to a difference between the cage's inner diameter 37 and the shell's diameter 38 so that the spacing 35 between the cage's inner face 15 and the drum shell 36 is maintained.

Next a drum head 40 is placed atop the cage 11 with a rim 41 of the drum head 40 positioned outside the cage's top edge 17. The rim 41 has a diameter 42 larger than the cage's outer diameter 12. A hoop 43 is placed in surrounding relation to the drum head 40. Next fasteners, here, screws 44 are inserted through hoop apertures 45 positioned in spaced relation around the rim 41 to coincide with the spacing of the post apertures 23. The screws 44 are tightened to a desired tension to secure the head, and the mounting clips 30 are removed.

Figure 4:
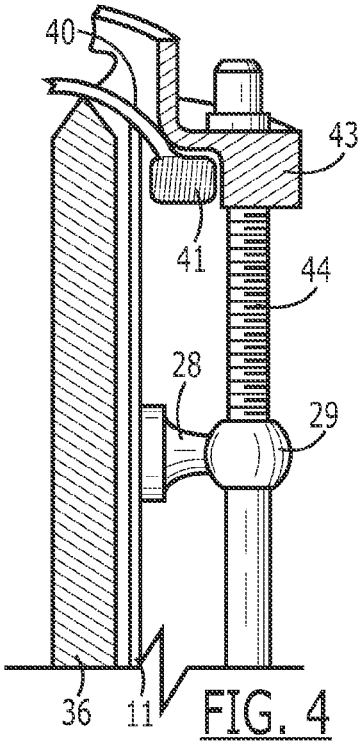
FIG. 4 is a side cross-sectional view of the mounting and tensioning system.

A more detailed view of the mounting system is given in FIG. 4, wherein the feature of the invention 10 comprising the positioning of the drum head 40 relative to the shell 36 is more apparent. Here it can be seen that the drum head 40 is stretched over the shell 36 and the cage 11 and held in place by its rim 41 being clamped between the hoop 43 and the cage 11. This portion of the process, referred to as pretensioning, is an important part of the invention, and serves to remove any wrinkles from the drum head 40 and begin the process of forming a musical note. The tuning method is also apparent from this drawing, as a tightening of the screws 44 will tighten the drum head 40. Preferably, the tightening is done in a manner known in the art, such as with replacing a tire, by applying pressure to screws 44 across from each other, and not fully tightening any one screw 44 all at once. If two drum heads 40 are being installed, the drum system 10 is then turned over, and the process is repeated for the second head 40.

Figure 5:
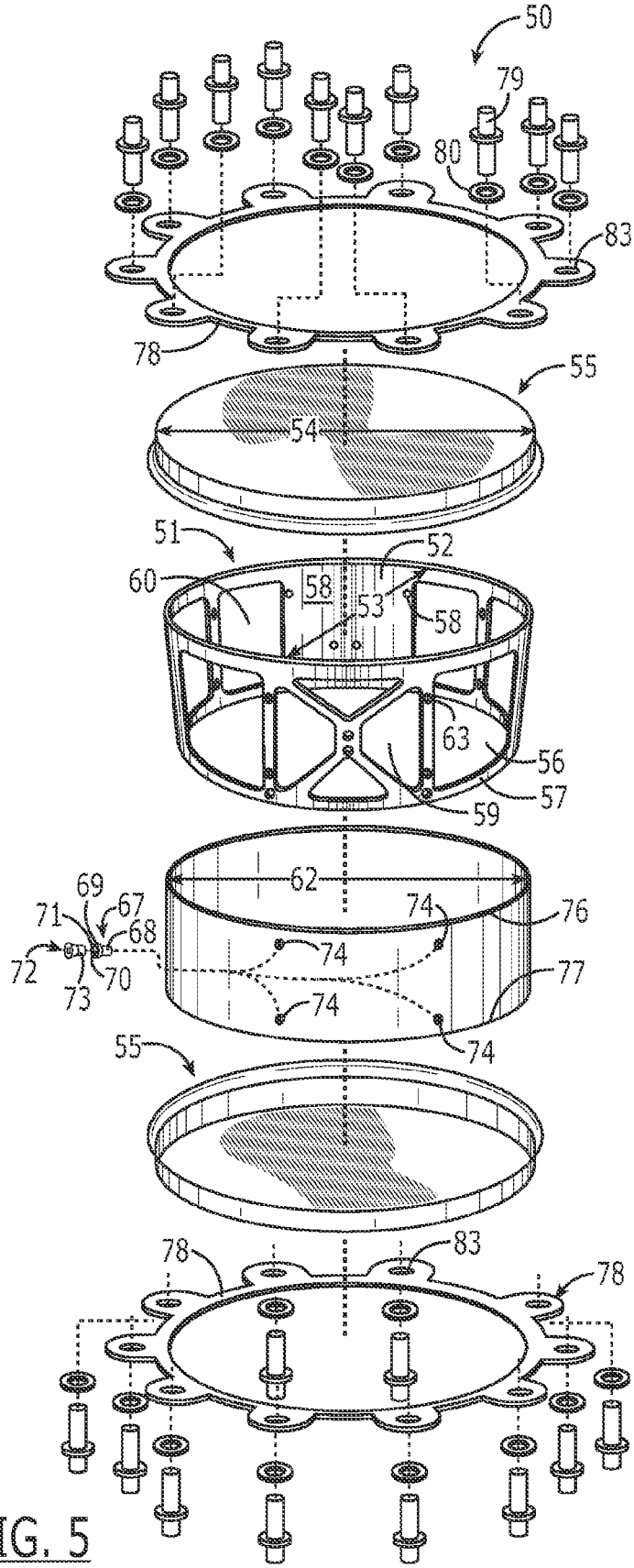
FIG. 5 is an exploded view of the drum shell mounting system in a second embodiment of the invention.
Figure 6:
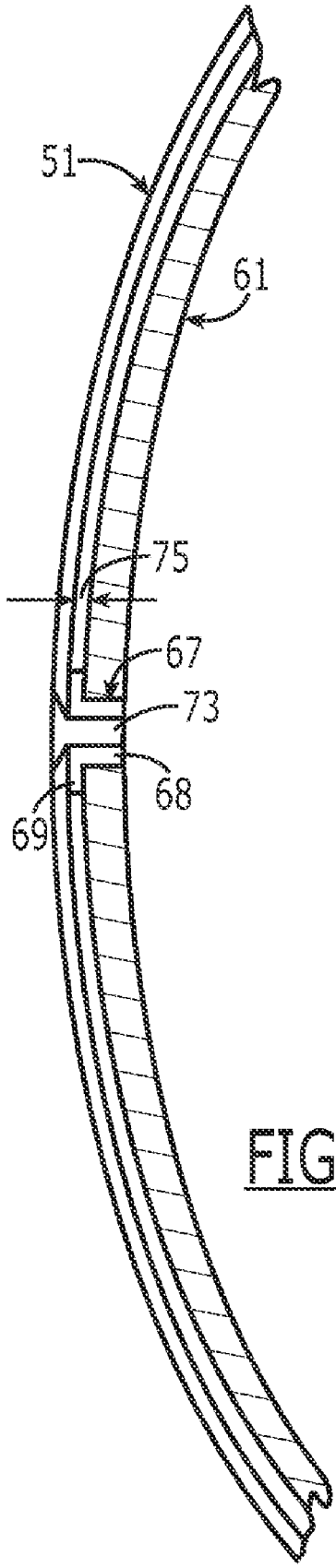
FIG. 6 is a side cross-sectional view of the spacer and alignment system of the system of FIG. 5.
Figure 7:
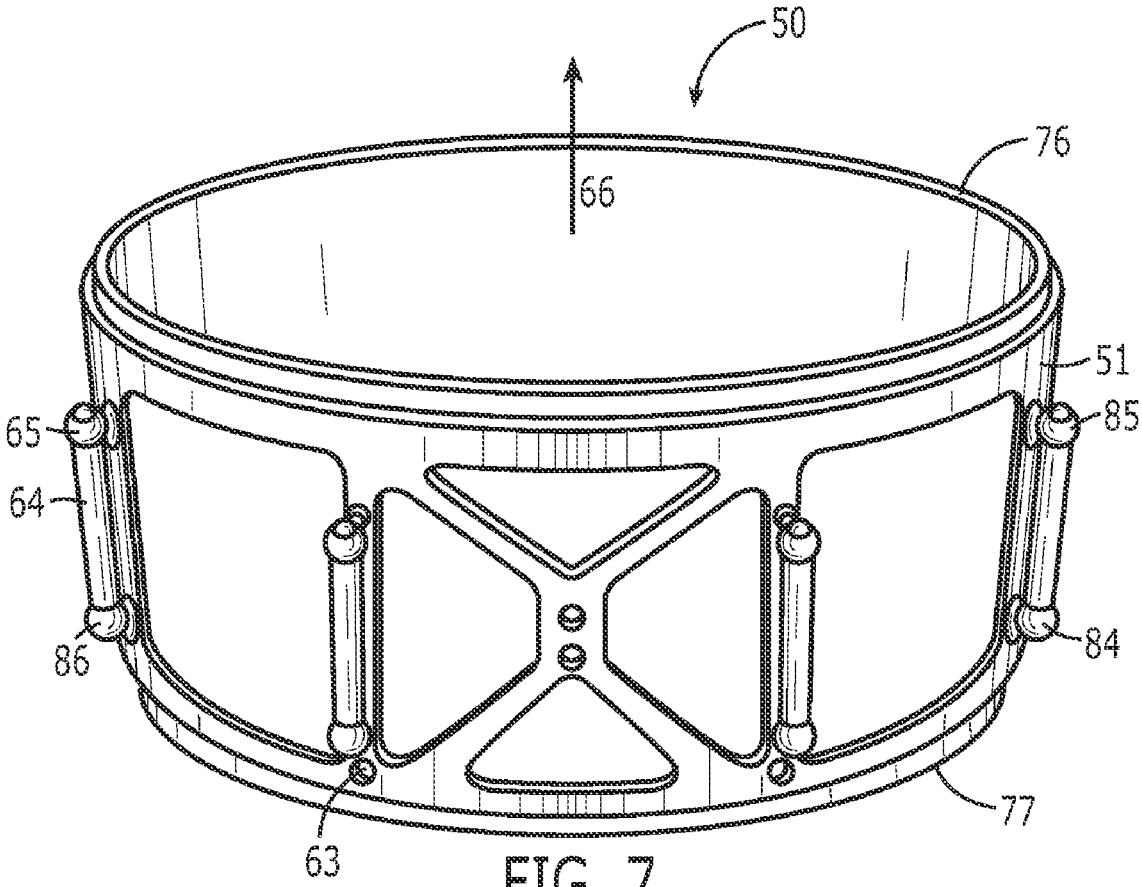
FIG. 7 is a side perspective view of the cage and shell of the embodiment of FIG. 5.
Figure 8:
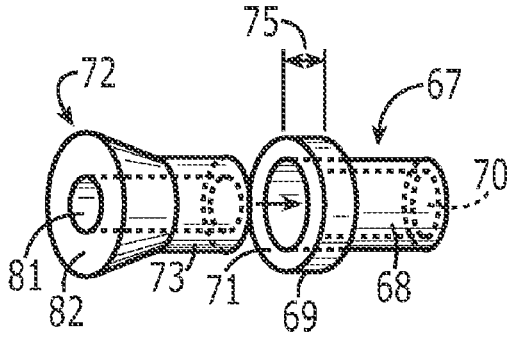
FIG. 8 is a side perspective exploded view of a pin and spacer.

A second embodiment of the invention is also directed to a drum shell mounting system 50 (FIGS. 5-8). This embodiment of the system 50 comprises a generally cylindrical cage 51 that has a wall portion 52 having an outer diameter 53 that is less than a diameter 54 of a drum head 55 (FIG. 5). A plurality of windows 56, here, nine, extend from an outer face 57 through to an inner face 58 thereof. One of the windows 59 has a "X"-shaped cross-piece therein. The cage 51 has an axial bore 60 therethrough that is dimensioned to admit a drum shell 61. The bore 60 further is larger than a diameter 62 of the drum shell 61 to be placed therein. A spacer hole 63, here four spacer holes, through the wall portion 52 extends from the outer face 57 through to the inner face 58.

A plurality of posts 64 are affixed to and extend outwardly from the cage outer face in circumferentially spaced relation therearound between the windows 56. The posts 64 each have apertures 65,84 extending from a top end 85 and a bottom end 86 thereof, respectively, the apertures 65 substantially parallel to a cylindrical axis 66 of the cage. The apertures 65,84 are for receiving fasteners 79 thereinto for affixing a top and a bottom drum head 55 to a top and bottom of the cage 51.

A spacer 67 has an insertion portion 68 that is dimensioned for insertion into a hole 74 in the drum shell 61. The spacer has a head portion 69 that is larger than the drum shell hole 63 and has an axial bore 70 therein extending from a top face 71 of the head portion 69. The spacer 67 acts as a spacer shim for the shell 61 to the hardware mounting system 50 or cage 51.

A pin 72 has an insertion portion 73 that is dimensioned for insertion through the cage's spacer hole 63 and into the spacer axial bore 70. The pin 72 and the spacer 67 thereby retain the shell 61 in spaced relation from the cage 51 by a space determined by an axial height 75 of the spacers head portion 69 (see FIG. 6). The pin 72 further has an axial bore 81 therethrough extending from a top face 82 of the pin 72. This axial bore 81 serves as the drum's vent hole, and also serves as a locking system for the cage 51 to the shell 61. The spacer 67 thus further acts as a means for braking or stopping the shell 51 when the pin 72 meshes with the spacer 67.

The above-described elements of the drum shell mounting system 50 are assembled as follows: The spacers 67 are inserted into the drum shell holes 74. The cage 51 is placed in surrounding relation to the drum shell 61, so that the cage holes 63 are aligned with the spacers 67. The pins 72 are inserted through the cage holes 63 and into the axial bore 70 of the spacers 67. The spacers 67 thus serve to ensure a desired spacing and horizontal alignment between the cage 51 and the shell 61, completely around the circumference of the system 50. Further, the spacers 67 ensure a desired vertical alignment, so that the shell 61, which is higher than the cage 51, has equal portions extending beyond the cage 51 at the top 76 and the bottom 77. Thus the cage 51 and shell 61 are substantially perfectly aligned and secured in that desired position.

Next the upper and lower drum heads 55 are placed over the top 76 and bottom 77 of the shell 61, and then the upper and lower drum hoops 78 are affixed with tuning keys 79 and washers 80 through hoop holes 83 circumferentially spaced about the hoop 78, to the posts 64. Then the user can tune as desired.

The features that characterize the invention, both as to organization and method of operation, together with further objects and advantages thereof, will be better understood from the following description used in conjunction with the accompanying drawing. It is to be expressly understood that the drawing is for the purpose of illustration and description and is not intended as a definition of the limits of the invention. These and other objects attained, and advantages offered, by the present invention will become more fully apparent as the description that now follows is read in conjunction with the accompanying drawing.

In the foregoing description, certain terms have been used for brevity, clarity, and understanding, but no unnecessary limitations are to be implied therefrom beyond the requirements of the prior art, because such words are used for description purposes herein and are intended to be broadly construed. Moreover, the embodiments of the system and device illustrated and described herein are by way of example, and the scope of the invention is not limited to the exact details of construction.

What is claimed is:

1. A drum shell mounting system comprising:

a generally cylindrical cage having a wall portion having an outer diameter less than a diameter of a drum head, a window extending from an outer face through to an inner face thereof, an axial bore therethrough dimensioned to admit a drum shell, the bore having a diameter larger than a diameter of the drum shell to be placed therein, and a spacer hole through the wall portion extending from the outer face through to the inner face;

a plurality of posts affixed to and extending outwardly from the cage outer face in circumferentially spaced relation therearound, the posts each having an aperture extending from a top end thereof, the apertures substantially parallel to a cylindrical axis of the cage and for receiving fasteners thereinto for affixing a drum head thereto;

a spacer having an insertion portion dimensioned for insertion into a hole in the drum shell and a head portion larger than the drum shell hole, the head portion having an axial bore therein extending from an outer face thereof; and a pin having an insertion portion dimensioned for insertion through the cage spacer hole and into the spacer axial bore, the pin and the spacer thereby retaining the drum shell in spaced relation from the cage, a space therebetween determined by an axial height of the spacer head portion.

2. The drum shell mounting system recited in claim 1, wherein the window comprises a plurality of windows positioned in circumferentially spaced relation about the cage.

3. The drum shell mounting system recited in claim 2, wherein the plurality of windows comprises nine windows.

4. The drum shell mounting system recited in claim 2, wherein the posts are affixed to the cage outer face at a position between the windows.

5. The drum shell mounting system recited in claim 1, wherein the cage spacer hole comprises four spacer holes.

6. The drum shell mounting system recited in claim 1, wherein the pin further has an axial bore extending from an outer face through to an inner face thereof.

7. The drum shell mounting system recited in claim 1, wherein the posts further each have an aperture extending from a bottom end thereof, for receiving fasteners thereinto for affixing a second drum head thereto.

8. A drum comprising:

a generally cylindrical drum shell;

a generally cylindrical cage having a wall portion having an outer diameter less than a diameter of the drum head, a window extending from an outer face through to an inner face thereof, a bore therethrough dimensioned to admit the drum shell, the bore having a diameter larger than a diameter of the drum shell to be placed therein, and a spacer hole through the wall portion extending from the outer face through to the inner face;

a generally circular drum head having a central head portion for being played upon;

an annular hoop portion affixable in surrounding relation to the drum head, the hoop portion having a plurality of holes therethrough positioned in circumferentially spaced relation therearound;

a plurality of posts affixed to and extending outwardly from the cage outer face in circumferentially spaced relation therearound, the posts each having an aperture extending from an end thereof, the apertures substantially parallel to a cylindrical axis of the cage and for receiving fasteners thereinto from the drum head hoop holes, for affixing the drum head thereto;

a spacer having an insertion portion dimensioned for insertion into a hole in the drum shell and a head portion larger than the drum shell hole, the head portion having an axial bore therein extending from an outer face thereof; and a pin having an insertion portion dimensioned for insertion through the cage spacer hole and into the spacer axial bore, the pin and the spacer thereby retaining the drum shell in spaced relation from the cage, a space therebetween determined by an axial height of the spacer head portion.

9. The drum recited in claim 8, wherein the window comprises a plurality of windows positioned in circumferentially spaced relation about the cage.

10. The drum recited in claim 9, wherein the plurality of windows comprises nine windows.

11. The drum recited in claim 9, wherein the posts are affixed to the cage outer face at a position between the windows.

12. The drum recited in claim 8, wherein the cage spacer hole comprises four spacer holes.

13. The drum recited in claim 8, wherein the pin further has an axial bore extending from an outer face through to an inner face thereof.

14. The drum recited in claim 8, wherein the drum head comprises a top drum head and a bottom drum head, the hoop portion comprises a top hoop portion and a bottom hoop portion, and wherein post end comprises a top end, and the posts further each have an aperture extending from a bottom end opposed to the top end thereof, the posts top end apertures for receiving fasteners thereinto from the top hoop holes, for affixing the top drum head thereto, the posts bottom end apertures for receiving fasteners thereinto from the second hoop holes, for affixing the bottom drum head thereto.

15. A method for mounting a drum shell comprising the steps of:

inserting a spacer into a hole in a generally cylindrical drum shell, an insertion portion of the spacer admittable into the drum shell hole, a head portion of the spacer dimensioned larger than the drum shell hole;

positioning a generally cylindrical cage in surrounding relation to the drum shell, the cage having a spacer hole through a wall portion extending from an outer face through to an inner face, the cage further having a plurality of posts affixed to the outer face and extending outwardly therefrom in circumferentially spaced relation therearound, the posts each having an aperture extending from a top end thereof, the apertures substantially parallel to a cylindrical axis of the cage;

aligning the cage spacer hole with the drum shell hole;

inserting a pin through the cage spacer hole and into an axial bore of the spacer, the pin and the spacer thereby retaining the drum shell in spaced relation from the cage, a space therebetween determined by an axial height of the spacer head portion;

placing a drum hoop around a generally circular drum head;

placing the drum head and drum hoop atop the cage, an outer edge of the drum head sandwiched between the drum hoop and a top edge of the cage; and affixing the drum hoop to the cage, by inserting fasteners through holes in the drum hoop into the post apertures.

16. The method recited in claim 15, wherein the pin further has an axial bore extending from an outer face through to an inner face thereof.

17. The drum shell mounting system recited in claim 15, wherein:

the drum hoop placing step comprises placing a top drum hoop around a top-drum head and placing a bottom drum hoop around a bottom drum head;

the drum head and drum hoop placing step comprises placing the top drum head and top drum hoop atop the cage and placing the bottom drum head and the bottom drum hoop on a bottom of the cage; and the drum hoop affixing step comprises inserting fasteners through holes in the top drum hoop into top post apertures and inserting fasteners through holes in the bottom drum hoop into bottom post apertures.

* * * * *